US007255594B2

(12) United States Patent
Huang et al.

(10) Patent No.: US 7,255,594 B2
(45) Date of Patent: Aug. 14, 2007

(54) CONNECTOR FOR FLEXIBLE PRINTED CIRCUIT BOARD

(75) Inventors: Chung-Shin Huang, Tucheng (TW); Yi Chiu Kao, Tucheng (TW); Yungchi Peng, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/305,101

(22) Filed: Dec. 19, 2005

(65) Prior Publication Data

US 2007/0141896 A1 Jun. 21, 2007

(30) Foreign Application Priority Data

Jan. 28, 2005 (TW) ..... 94201630 U

(51) Int. Cl.
*H01R 12/24* (2006.01)

(52) U.S. Cl. ..... 439/495

(58) Field of Classification Search ..... 439/495, 439/496, 260

See application file for complete search history.

(56) References Cited

U.S. PATENT DOCUMENTS

| | | | | |
|---|---|---|---|---|
| 6,089,905 | A * | 7/2000 | Shimmyo et al. | 439/260 |
| 6,352,442 | B1 * | 3/2002 | Kudo | 439/495 |
| 6,431,907 | B1 * | 8/2002 | Ma | 439/495 |
| 6,471,541 | B2 * | 10/2002 | Kunishi et al. | 439/495 |
| 6,514,101 | B1 * | 2/2003 | Miura | 439/495 |
| 6,517,367 | B2 * | 2/2003 | Yamane | 439/260 |
| 6,533,606 | B2 * | 3/2003 | Yamane | 439/495 |
| 6,755,682 | B2 * | 6/2004 | Kunishi et al. | 439/495 |
| 6,921,274 | B2 * | 7/2005 | Yu | 439/260 |
| 2002/0115340 | A1 * | 8/2002 | Yamane | 439/495 |
| 2003/0232536 | A1 * | 12/2003 | Saito et al. | 439/495 |
| 2004/0002254 | A1 * | 1/2004 | Tsunematsu | 439/495 |
| 2004/0180572 | A1 * | 9/2004 | Chiu | 439/495 |
| 2004/0235341 | A1 * | 11/2004 | Chiu | 439/495 |
| 2005/0208824 | A1 * | 9/2005 | Kayama et al. | 439/495 |
| 2005/0260885 | A1 * | 11/2005 | Lu | 439/495 |

* cited by examiner

*Primary Examiner*—Chandrika Prasad
*Assistant Examiner*—Harshad C Patel
(74) *Attorney, Agent, or Firm*—Rosenberg, Klein & Lee

(57) ABSTRACT

A connector for FPC board includes an insulating housing and a cover plate. The insulating housing has a receiving space for receiving an FPC board, a plurality of passageways, and two guiding channels. A plurality of terminals is received in the corresponding passageways. Each terminal has a contact portion and a pressing portion. The cover plate has two rotational shafts put into the corresponding guiding channels, whereby the two rotational shafts are rotatable in and slidable along the guiding channels. When the cover plate is rotated to a horizontal position, the rear end of the cover plate lies to the front of the pressing portions of the terminals. Then, when the rotational shafts together with the cover plate are horizontally slid from front to rear, the cover plate is inserted between the pressing portions and the FPC board, and the pressing portions press the cover plate against the FPC board, and the cover plate presses the FPC board against the contact portions of the terminals. Therefore the FPC board is retained stably in the connector.

2 Claims, 3 Drawing Sheets

CONNECTOR FOR FLEXIBLE PRINTED CIRCUIT BOARD

BACKGROUND OF THE INVENTION

1. Field of the Invention

The present invention generally relates to an electrical connector and, more particularly, to an electrical connector for terminating a flexible printed circuit board or the like.

2. The Related Art

Nowadays, Flexible Printed Circuit (FPC) boards are widely used in many kinds of electronic devices for their high flexibility and thin structure. Accordingly, connectors for connecting the FPC boards to other electrical components of the electronic devices are mass-employed.

One example of the connectors of the prior art is disclosed in U.S. Pat. Publication No. 2002/0106924 published on Aug. 8, 2002. The connector includes contacts each having a contact portion to be brought into contact with the flexible printed circuit board or flexible flat cable, a block for holding and fixing the contacts therein, and a slider mounted on the block. Two pivotal engagement recesses are formed on the opposite lateral sides of the block. Bearing portions are located in front of the pivotal engagement recesses. The slider comprises camshaft portions pivotally mounted in the pivotal engagement recesses to permit the slider to move pivotally and horizontally relative to the block and an urging portion causing the flexible printed circuit board (FPC) or flexible flat cable (FFC) to urge against contact portions of contacts. Each contact further comprises a guiding portion for guiding the movement of the slider.

In assembly, at first, open the slider and insert the external flexible printed circuit or flexible flat cable between the contact portions and the guiding portions of the contacts. Then, rotate the slider to be closed. Under the engagement of the camshafts and the bearing portions and the guiding of the guiding portions of the contacts, the urging portion of the slider is rotated to a horizontal position and simultaneously move forward between the guiding portions and the external flexible printed circuit or flexible flat cable. When the slider is rotated to a closed horizontal position, the urging portion of the slider is entirely inserted between the guiding portions and the external flexible printed circuit or flexible flat cable. In the result, the guiding portions of the contacts prop downwardly the top surface of the slider and the slider prop downwardly the external flexible printed circuit or flexible flat cable, therefore the external flexible printed circuit or flexible flat cable is mechanically and electrically connected with the electrical connector.

In the assembly of the electrical connector, the urging portion of the slider tends to move rearward because the external flexible printed circuit or flexible flat cable props the urging portions of the slider rearward. However, the bearing portions of the block restrain the camshaft portions from moving rearward, therefore the middle part of the urging portion is prone to be extracted out between the guiding portions of the contacts and the external flexible printed circuit or flexible flat cable so that the urging portion can not effectively prop against the external flexible printed circuit or flexible flat cable. As a result, the external flexible printed circuit or flexible flat cable can not be retained reliably in the electrical connector.

Furthermore, the rotation of the slider and the horizontal movement of the slider happen on the same time, therefore the guiding portions of the contacts are prone to be fatigued for too seriously biased by the urging portion of the slider so that the guiding portions can not effectively prop against the urging portion of the slider, with the result that the external flexible printed circuit or flexible flat cable can not be retained stably and reliably.

Hence, an improved connector for connecting an external FPC board is required to overcome the disadvantages of the prior art.

SUMMARY OF THE INVENTION

A major object of the present invention is to provide an FPC electrical connector for retaining an FPC board reliably.

The present invention provides a connector for receiving a flexible printed circuit board. The connector for flexible printed circuit board includes an insulating housing and a cover plate. The insulating housing has a receiving space opened to the front for an external flexible printed circuit board being horizontally inserted therein from front to rear. A plurality of passageways is defined in the insulating housing. Two guiding channels are disposed in two opposite sides of the insulating housing. A plurality of terminals is received in the corresponding passageways of the insulating housing. Each terminal has a contact portion and a pressing portion. The cover plate has two rotational shafts on two opposite sides thereof. The two rotational shafts are put into the corresponding guiding channels of the insulating housing, whereby the two rotational shafts are rotatable in and slidable along the guiding channels. When the cover plate is rotated to a horizontal position, the rear end of the cover plate lies to the front of the pressing portions of the terminals. Then, when the rotational shafts together with the cover plate are horizontally slid from front to rear, the cover plate is inserted between the pressing portions of the terminals and the flexible printed circuit board, and the pressing portions of the terminals press the cover plate against the flexible printed circuit board, and the cover plate presses the flexible printed circuit board against the contact portions of the terminals. Therefore the flexible printed circuit board is retained stably in the connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
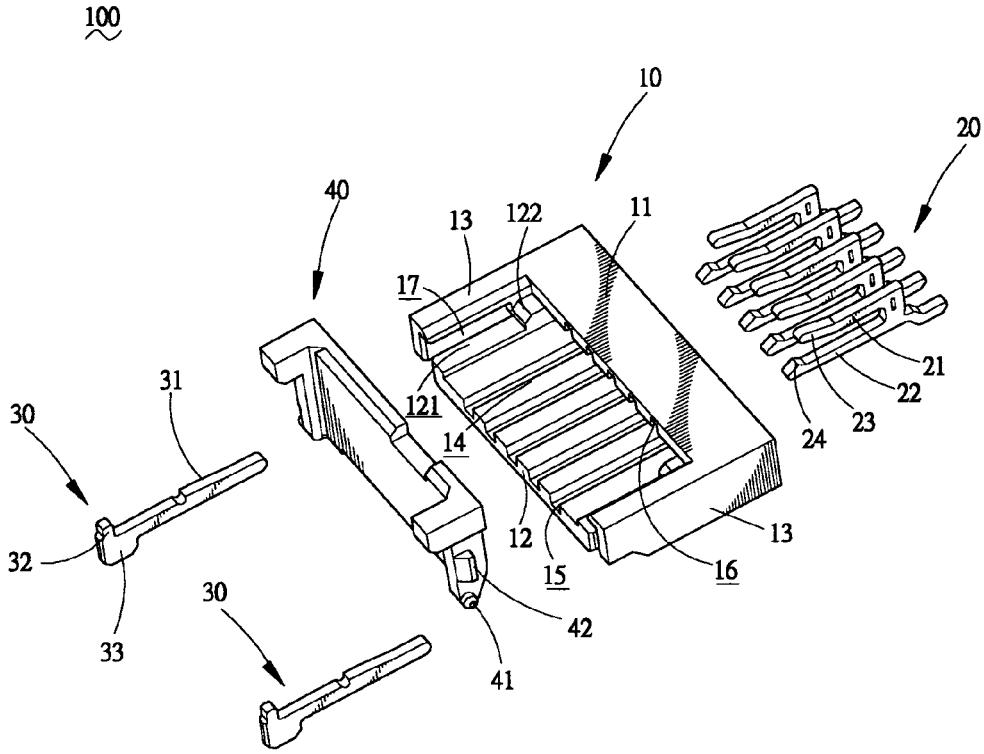
FIG. 1 is an exploded perspective view of a connector for flexible printed circuit board in accordance with the present invention.

Referring to FIG. 1, a connector 100 for FPC board comprises an insulating housing 10 with a plurality of terminals 20 and a pair of latches 30, a cover plate 40 engaged with the insulating housing 10.

The insulating housing 10 has a base plate 11 with a bottom plate 12 formed on the bottom thereof and a pair of sidewalls 13 formed on the opposite sides thereof. A receiving space 14 for accommodating an external FPC board (not shown) is defined between the base plate 11 and the bottom plate 12. A pair of sliding recesses 121 is formed on the inner surfaces of the sidewalls 13 for receiving a pair of latches 30 therein. A pair of stops 122 is neighboring the pair of sliding recesses 121. A plurality of lower passageways 15 and a plurality of upper passageways 16 are respectively disposed on the bottom plate 12 and the base plate 11. The lower passageways 15 and the upper passageways 16 communicate with outside space and the receiving space 14. A pair of guiding channel 17, which communicates with the corresponding sliding recesses 121 and extends to the front surface of the stops 122, are set on the corresponding sidewalls 13.

Figure 2:
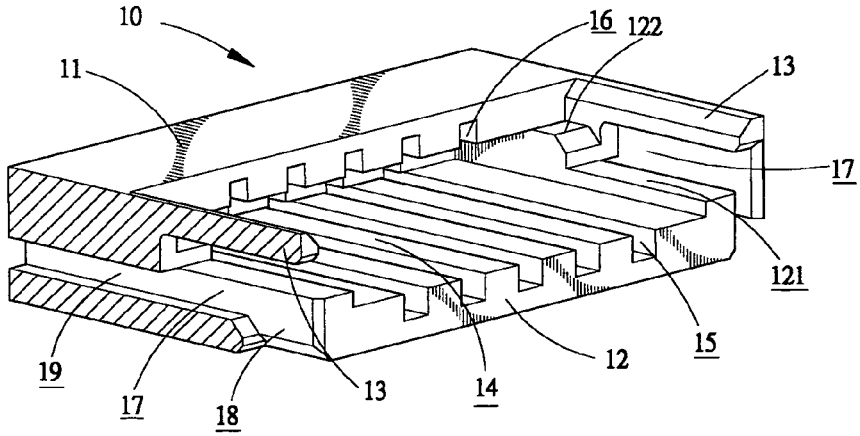
FIG. 2 is a cross-sectional perspective view of an insulating housing for the connector of FIG. 1.

Please further refer to FIG. 2. A soldering recess 18 is extended downwardly from the front end of the bottom of the corresponding guiding channel 17. An engagement aperture 19 is extended backwardly from the back end of the corresponding guiding channel 17.

Each terminal 20 comprises an upper portion 21 and a bottom portion 22. The upper portion 21 has a portion used as a pressing portion 23. The bottom portion 22 has a contact portion 24 at the free end thereof. Each latch 30 has an inserting portion 31 extended longitudinally. A blocking portion 32 and a soldering portion 33 are respectively upwardly and downwardly extended from the front end of the inserting portion 31.

The cover plate 40 is flat. A pair of rotational shafts 41 extends from the opposite side surfaces of the cover plate 40 for being movably received in the guiding channels 17. A pair of wedges 42 is formed on the nearly middle part of the opposite surfaces of the cover plate 40. The cover plate 40 has a guiding recess 43 in the nearly middle part of the top and back of the cover plate 40 (as shown in FIG. 6).

Figure 3:
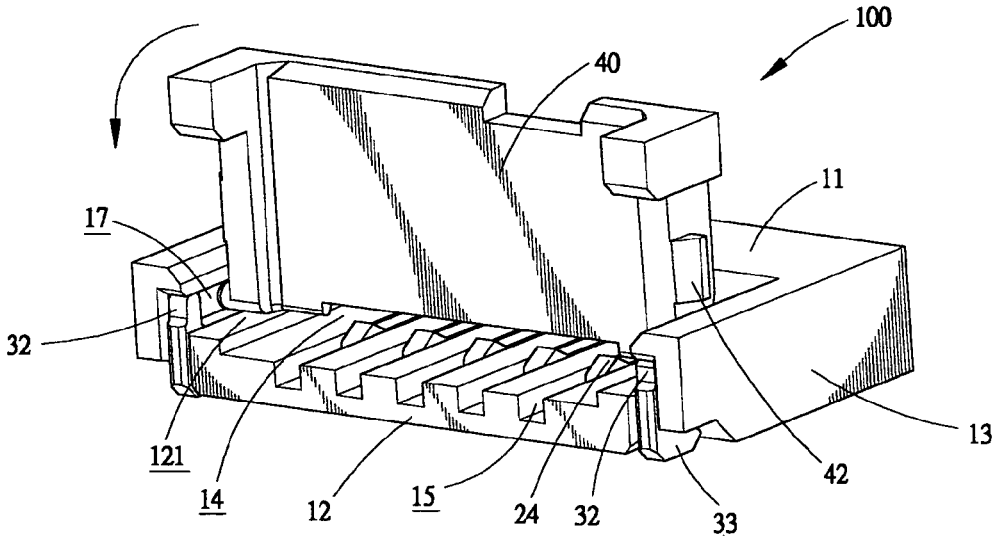
FIG. 3 is a perspective view of the connector with a cover plate for the connector opened.

Referring to FIG. 3, in assembly, the upper portion 21 and the bottom portion 22 of each terminal 20 are respectively received in the corresponding upper passageway 16 and the corresponding lower passageway 15 of the insulating housing 10. The cover plate 40 is mounted on the insulating housing 10 with the rotational shafts 41 of the cover plate 40 received in the guiding channels 17 and the wedges 42 of the cover plate 40 wedged into the guiding channels 17. The inserting portions 31 of the latches 30 are received in the corresponding engagement apertures 19 of the guiding channels 17. The blocking portions 32 of the latches 30 enclose the guiding channels 17 of the insulating housing 10 to prevent the cover plate 40 from being disengaged with the insulating housing 10. The soldering portions 33 of the latches 30 are accommodated in the soldering recesses 18 of the insulating housing 10 to be soldered with an outside circuit board (not shown).

Figure 4:
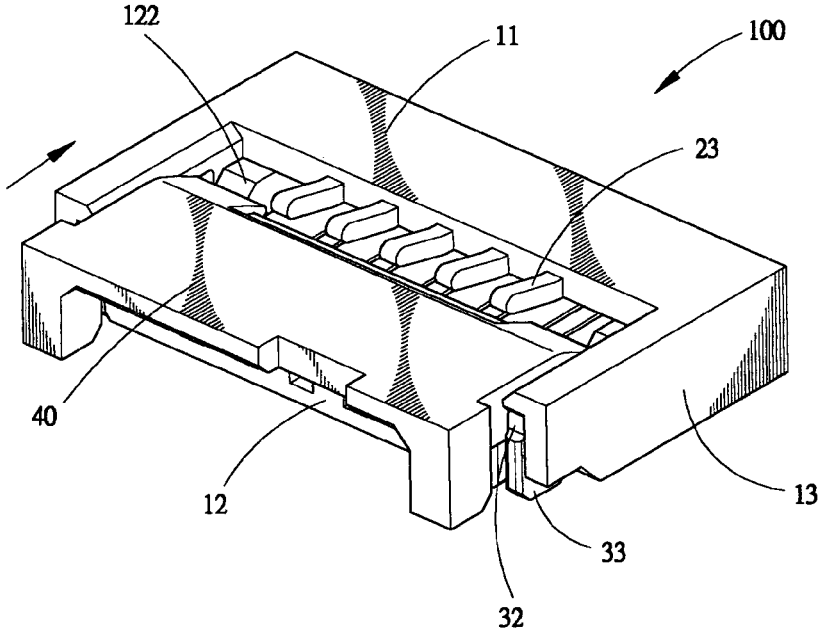
FIG. 4 is a perspective view of the connector with the cover plate rotated to a horizontal, initial closing position.
Figure 5:
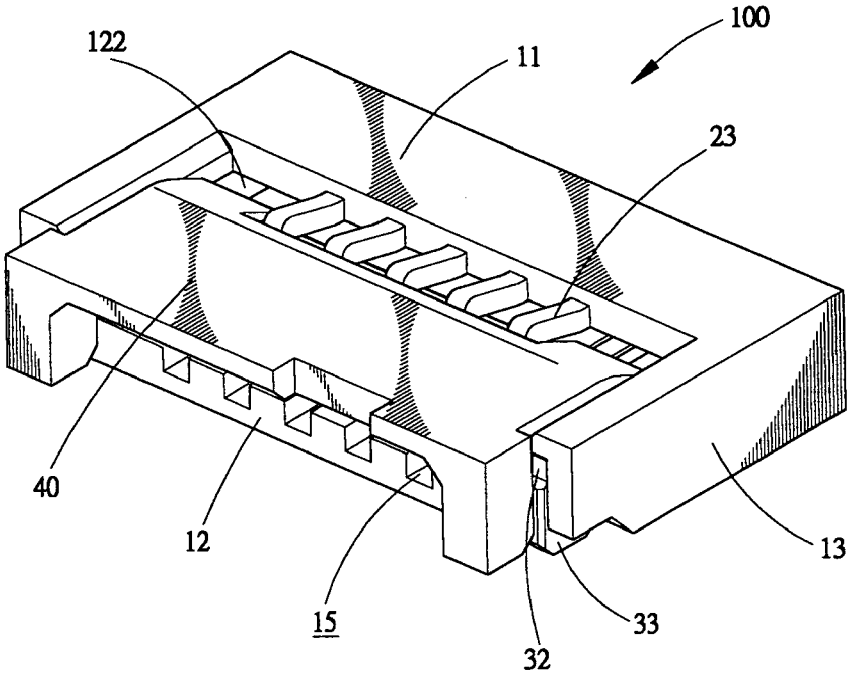
FIG. 5 is a perspective view of the connector seen from front, illustrating the cover plate being slid horizontally to a final closing position.
Figure 6:
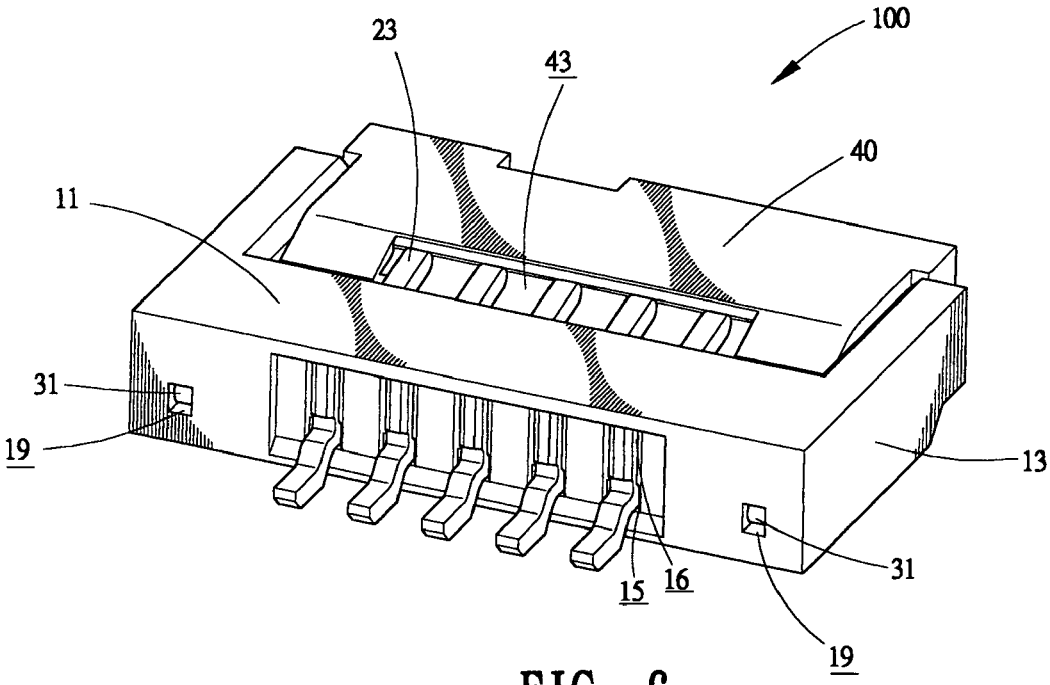
FIG. 6 is a perspective view of the connector seen from back, illustrating the cover plate being slid horizontally to a final closing position.

Please refer to FIG. 3 in conjunction with FIGS. 4, 5 and 6. When the cover plate 40 is opened, an FPC board can be inserted, from front to rear, into the receiving space 14 and between the pressing portions 23 and the contact portions 24 of the terminals 20. When the cover plate 40 is rotated in the arrow directed direction in FIG. 3 to a horizontal position, as shown in FIG. 4, the cover plate 40 is closed in an initial closing position with the rear end of the cover plate 40 still lying to the front of, not under, the pressing portions 23 of the terminals 20. Then push the cover plate 40 in the arrow directed direction in FIG. 4 to make the rotational shafts 41 together with the cover plate 40 slide backwardly gradually along the guiding channel 17 of the insulating housing 10 till the cover plate 40 is stopped by the stops 122 of the insulating housing 10. At this state, the cover plate 40 is closed in a final closing position as shown in FIG. 5. During moving the cover plate 40 backwardly, the guiding recess 43 of the cover plate 40 gradually guides the pressing portions 23 of the terminals 20 propping on the top of the cover plate 40. Thus, in the final closing position, the cover plate 40 is inserted between the pressing portions 23 of the terminals 20 and the FPC board, and the pressing portions 23 press the cover plate 40 against the FPC board, and the cover plate 40 presses the FPC board against the contact portions 24 of the terminals 20. Therefore, the FPC board is retained stably in the connector 100.

As the above mentioned, when the cover plate 40 rotates to a horizontal, initial closing position, the rear of the cover plate 40 is in front of the front ends of the pressing portions 23 of the terminals 20 as there is enough movement space provided by the guiding channels 17 of the insulating housing 10. Therefore, the opposite sides and the middle part of the cover plate 40 can then be inserted simultaneously and horizontally between the pressing portions 23 of the terminals 20 and the FPC board, whereby preventing the cover plate 40 from being extracted out. Furthermore, the pressing portions 23 only have tiny displacement in the vertical direction as the cover plate 40 is horizontally inserted under the pressing portions 23 of the terminals 20, therefore such design will not fatigue the terminals 20.

While the present invention has been described with reference to what are presently considered to be preferred embodiment thereof, it is understood that the invention is not limited to the disclosed embodiment. On the contrary, the invention is intended to cover various modifications and equivalent arrangements. In addition, while the various elements of the disclosed invention are shown in various combinations and configurations, which are exemplary, other combinations and configurations, including more, less or only a single embodiment or element, are also within the spirit and scope of the invention.

What is claimed is:

1. A connector for flexible printed circuit board, comprising:

an insulating housing having a receiving space opened to the front for receipt of an external flexible printed circuit board being horizontally inserted therein longitudinally from front to rear, a plurality of passageways being defined in said insulating housing, two guiding channels being longitudinally disposed in two opposite sides of said insulating housing, and a pair of engagement apertures formed in two opposite sides of said insulating housing and extending longitudinally through the rear of the housing, each engagement aperture being in open communication with a corresponding one of said guiding channels;

a plurality of terminals received in the corresponding passageways of said insulating housing, each terminal having a contact portion and a pressing portion;

a cover plate being displaceable between at least a first vertical position and a second horizontal position and having two rotational shafts and two wedges formed on two opposite sides thereof, said two wedges being wedged into respective ones of said two guiding channels of said insulating housing, each of said two rotational shafts being disposed in a corresponding one of said guiding channels of said insulating housing, said cover plate being rotatably and slidably displaceable along said guiding channels, wherein when said cover plate is in said second horizontal position said pressing portions of said terminals are positioned above said cover plate to thereby apply a force thereto and press said cover plate against said flexible printed circuit board, and said cover plate pressing said flexible printed circuit board against said contact portions of said terminals, thereby providing connections between said flexible printed circuit board and said terminals; and a pair of latches, each latch having a blocking portion at a proximal end and an inserting portion at a distal end, said inserting portion of said latches being respectively inserted into said engagement apertures through said guiding channels with said blocking portions forming a closure for a front of said guiding channels to respectively capture said rotational shafts of said cover plate within said corresponding guiding channels.

2. The connector for flexible printed circuit board as claimed in claim 1, wherein a guiding recess is disposed on the top and back of said cover plate for guiding the pressing portions of said terminals propping upon the top surface of said cover plate.

* * * * *